US007722745B2

(12) United States Patent
von Detten

(10) Patent No.: US 7,722,745 B2
(45) Date of Patent: May 25, 2010

(54) DEVICE FOR PLATING CONTACTS IN HERMETIC CONNECTOR ASSEMBLIES

(76) Inventor: Volker von Detten, 535 E. Walnut Ave., El Segundo, CA (US) 90245

( * ) Notice: Subject to any disclaimer, the term of this patent is extended or adjusted under 35 U.S.C. 154(b) by 997 days.

(21) Appl. No.: 11/191,370

(22) Filed: Jul. 27, 2005

(65) Prior Publication Data

US 2008/0006526 A1 Jan. 10, 2008

Related U.S. Application Data

(60) Provisional application No. 60/591,270, filed on Jul. 27, 2004.

(51) Int. Cl.
*C25D 17/10* (2006.01)

(52) U.S. Cl. ..... 204/224 R; 204/227; 205/128; 205/134

(58) Field of Classification Search ..... 204/198, 204/222, 224 R, 280, 297.01; 205/128, 134
See application file for complete search history.

(56) References Cited

U.S. PATENT DOCUMENTS 2,081,787 A * 5/1937 Boss ..... 205/353
3,951,772 A * 4/1976 Bick et al. ..... 204/198
4,364,801 A * 12/1982 Salama ..... 205/122
6,821,145 B1 * 11/2004 Pollock et al. ..... 439/559
2003/0106802 A1 * 6/2003 Hagiwara et al. ..... 205/297
2003/0150717 A1 * 8/2003 Gnann et al. ..... 204/254

* cited by examiner

*Primary Examiner*—Nam X Nguyen
*Assistant Examiner*—Luan V Van

(57) ABSTRACT

This invention relates generally to a method and apparatus for electroplating selected portions of elongate and generally cylindrical metallic articles pre assembled and held in spaced-apart fashion into a nonconductive support member encircled by a metallic tube like member one portion of article extending from one side of support member with the opposing portion of article extending from the opposing end of support member including a locating device to receive the articles so the portion of the articles to be electroplated extends downwardly. At least one plating cell is provided adjacent the lower region for contacting the downwardly extending portion of the articles with plating liquid whereas the plating liquid is ejected towards the articles including at least one conducting device for electric current is provided adjacent to the upper region for engaging with the portion of article extending upwardly whereas the electric current is being distributed to articles evenly and complete.

9 Claims, 16 Drawing Sheets

DEVICE FOR PLATING CONTACTS IN HERMETIC CONNECTOR ASSEMBLIES

RELATED APPLICATIONS

This application claims the priority date of a prior filed application having Ser. No. 60/591,270 and filing date of Jul. 27, 2004 and entitled: Device to plate contacts assembled in a hermetic connector assembly.

BACKGROUND OF THE INVENTION

Incorporation By Reference

Applicant(s) herein incorporate by reference, any and all U.S. patents and U.S. patent applications cited or referred to in this application.

1. Field of Invention

This invention relates to electroplating and more particular to the localized plating of different areas of a pre-assembled part with various metals.

2. Description of Related Art

The following art describes the present state of this field:

Electroplating is a coating process for metals to be applied onto a basis metal surface. The coating or plating process is accomplished by means of an electrolyte solution which enables the to be plated metal to be deposited from either metal chip anodes (same metal as to be plated) or neutral metal anodes for plating from the electrolyte through application of a current. The current is supplied by means of a rectifier or power supply. The current is variable whereby the voltage is low and constant. The positive terminal of the rectifier is connected to the anode and the negative terminal to the to be plated part or cathode. Both the anode and parts or cathode typically are fully submerged in the electrolyte. The electrolyte is water based with dissolved salts thus making the electrolyte conductive sustaining a relative low electrical resistance. Once current is applied to the now closed circuit the metal is being deposited onto the part's surface. In case of precious metal plating and specifically gold the gold is suspended in form of gold salts in the electrolyte. The current will enable the gold to be carried out of suspension and deposited onto the part. Whichever portion of the part is selected to be submerged in the electrolyte that is the portion, which will be plated with gold. A hermetic connector is fabricated using a plurality of independent pins or contacts held in a spaced apart fashion by the insulator or glass seal. Usually the connector has a stainless steel outer body or shell and the contacts are fused into the glass insulator to completely encircle the inner extremity of the shell. When the contacts are being plated the shell must be electrically insulated from the contacts, as they have to connect with a conductor for the application of current for the plating process. As there is a plurality of contacts it is essential that all contacts have a proper connection to the power supply via conductor. The shell is usually in very close proximity of contacts and thus it is very critical that the connections of the conductor to the contacts is secure meaning that said conductor is not within any proximity to touch the shell during the plating process. Hermetic connectors are of many different sizes and carry contacts of many different size, numbers and array or layout arrangements. It is a fact that the number of hermetic connectors differing from each other is in the range of many hundreds. Further more the manufacturing process for these connectors due to their required performance criterion bears certain deficiencies which at least one of them is the inaccuracy of installed contacts manifested by variable contact length measured from the plane of datum to the plane of contact upper extremity within an array. This variability in contact length within the same array in combination with the many differing connector arrangements as aforesaid makes it very difficult at least to apply a universal and low cost method toward plating hermetic connectors.

In the prior art a plating method for contacts of hermetic connectors is known wherein the portion of contact protruding from the glass insulator are individually wrapped with fine copper wire at the lowest accessible portion of contact meaning the wrapping is required to be as close as achievable to the surface of glass insulator. The wires serve as electrical connection leads for plating current after the completely wire wrapped connector is submerged into a plating solution for the plating process to commence. This method is very costly due to several factors one of them at least the extensive labor cost for the wire wrapping in need to be amortized. This method is further defective in that the thickness of plating deposit is often uneven depending on the contact resistance of wire connection to the contact. Also the copper wires leave an undesirable blank spot or unplanted area on the contact after the plating process is finished. Further more during the plating process plating electrolyte cannot be adequately agitated inside the connector cavity causing at least on occasions a poor quality of plating and consistently extensive plating cycle times. It is well known in the industry what the deficiencies are with this process and how said deficiencies are being manifested through cost incurrence. In most cases the plating applied to most hermetic connectors is gold. This accentuates the need for an efficient plating process with the objective to reduce the high cost of gold.

No prior art device is known to achieve discrete plating of contact pins in hermetic connectors describing a method and apparatus for electroplating selected portions of the contact pins and specifically describing a method wherein contact pins are plated simultaneously, consistently and accurately wherein all selected portions of contacts and hermetic connector not to be plated remain so consistently not plated.

SUMMARY OF INVENTION

The present invention teaches certain benefits in construction and use, which give rise to the objectives described below.

This invention relates generally to a method and apparatus for electroplating selected portions of elongate and generally cylindrical metallic articles pre assembled and held in spaced-apart fashion into a nonconductive support member encircled by a metallic tube like member one portion of article extending from one side of support member with the opposing portion of article extending from the opposing end of support member including a locating device to receive the articles so the portion of the articles to be electroplated extends downwardly. At least one plating cell is provided adjacent the lower region for contacting the downwardly extending portion of the articles with plating liquid whereas the plating liquid is ejected towards the articles including at least one conducting device for electric current is provided adjacent to the upper region for engaging with the portion of article extending upwardly whereas the electric current is being distributed to articles evenly and complete.

A primary objective of one embodiment of the present invention is to provide an apparatus and method of use of such apparatus that yields advantages not taught by the prior art.

A still further objective is to assure that an embodiment of the invention is capable of plating individual contacts of hermetic connector without wrapping individual contacts with an individual copper wire.

A further objective is to assure that an embodiment of the invention is capable of isolating the outer shell of hermetic connector so that said shell does not get plated.

A still further objective is to assure that an embodiment of the invention is capable of plating the individual contacts of hermetic connector simultaneously, complete and at high speed.

A still further objective is to assure that an embodiment of the invention is to assure that individual contacts of hermetic connector are plated at uniform thickness of plating.

A still further objective is to assure that an embodiment of the invention is that the engagement end of individual contact of hermetic connector can be plated at a higher thickness than the opposing connection end of individual contact of same hermetic connector.

A still further objective is to assure that an embodiment of the invention is that preparation of hermetic connector for plating process does not require skilled labor and is relatively easy to use.

A still further objective is to assure that an embodiment of the invention that hermetic connectors of various dimensions and individual contact configurations and numbers can be plated without the need for labor intensive changes between production batches of hermetic connector. Aforesaid shall result in maximization of efficiency, reduction in labor and reduction in capital expenditures for the plating equipment.

Other features and advantages of the embodiments of the present invention will become apparent from the following more detailed description, taken in conjunction with the accompanying drawings, which illustrate, by the way of example, the principles of at least one of the possible embodiments of the invention.

BRIEF DESCRIPTION OF THE DRAWINGS

The accompanying drawings illustrate at least one of the best mode embodiments of the present invention. In such drawings.

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should not be taken as limiting the invention as defined in the following.

DETAILED DESCRIPTION OF THE DRAWINGS

Figure 1:
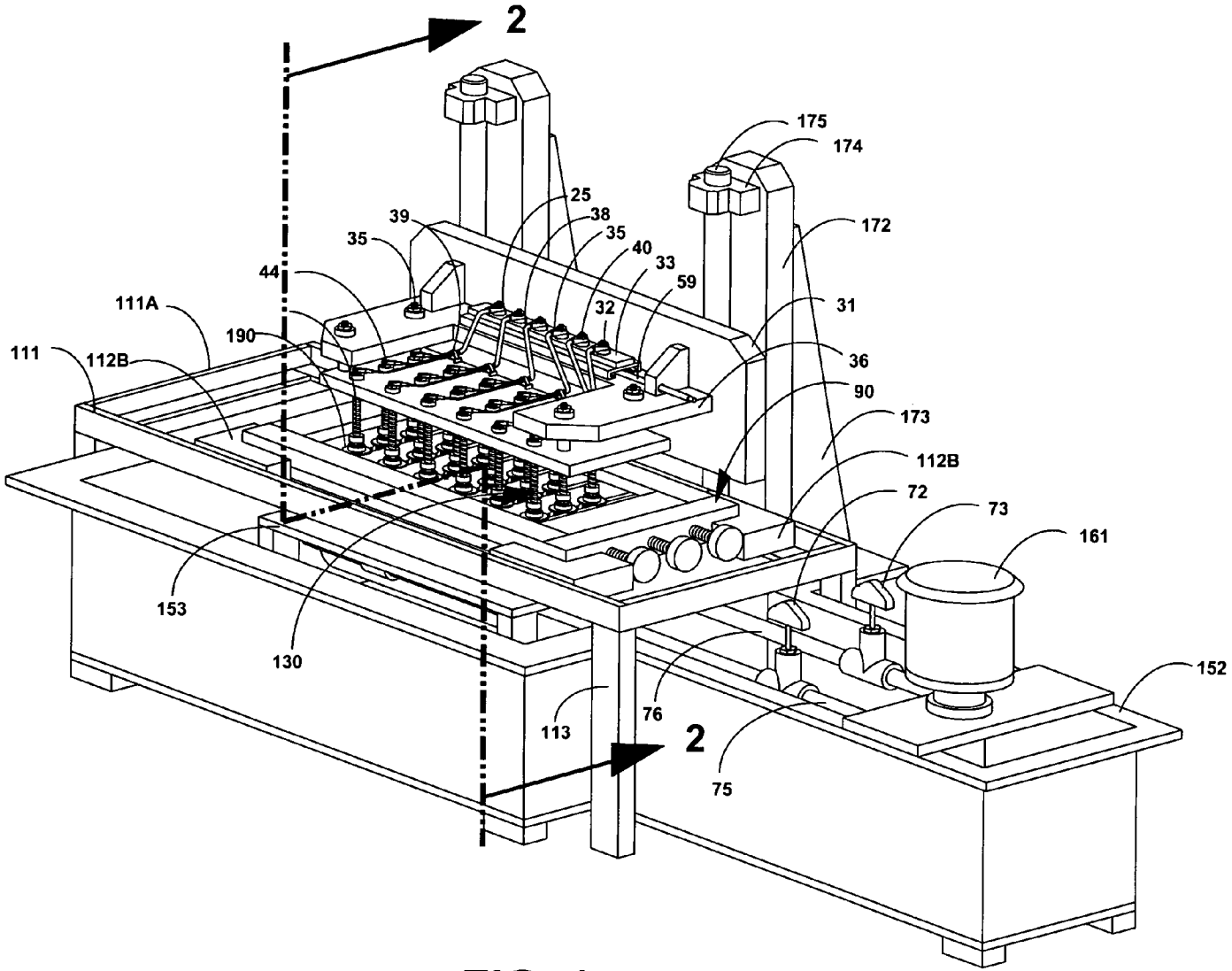
FIG. 1 is a perspective view of a preferred embodiment of present invention showing a process tank with a receiving device having hermetic connector engaged with conducting device.
Figure 6:
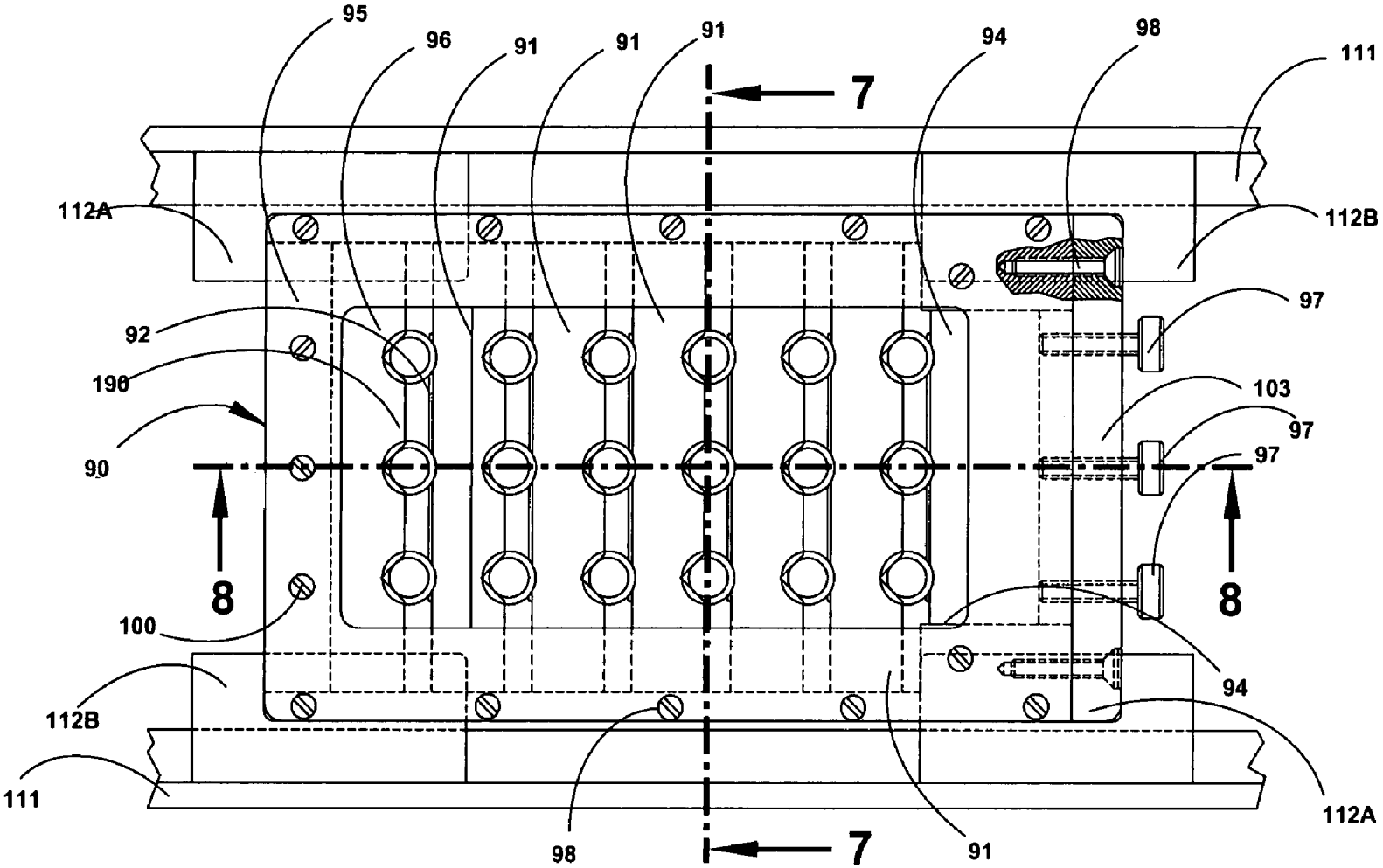
FIG. 6 is a plan view taken along lines 6-6 respectively in FIG. 5.
Figure 7:
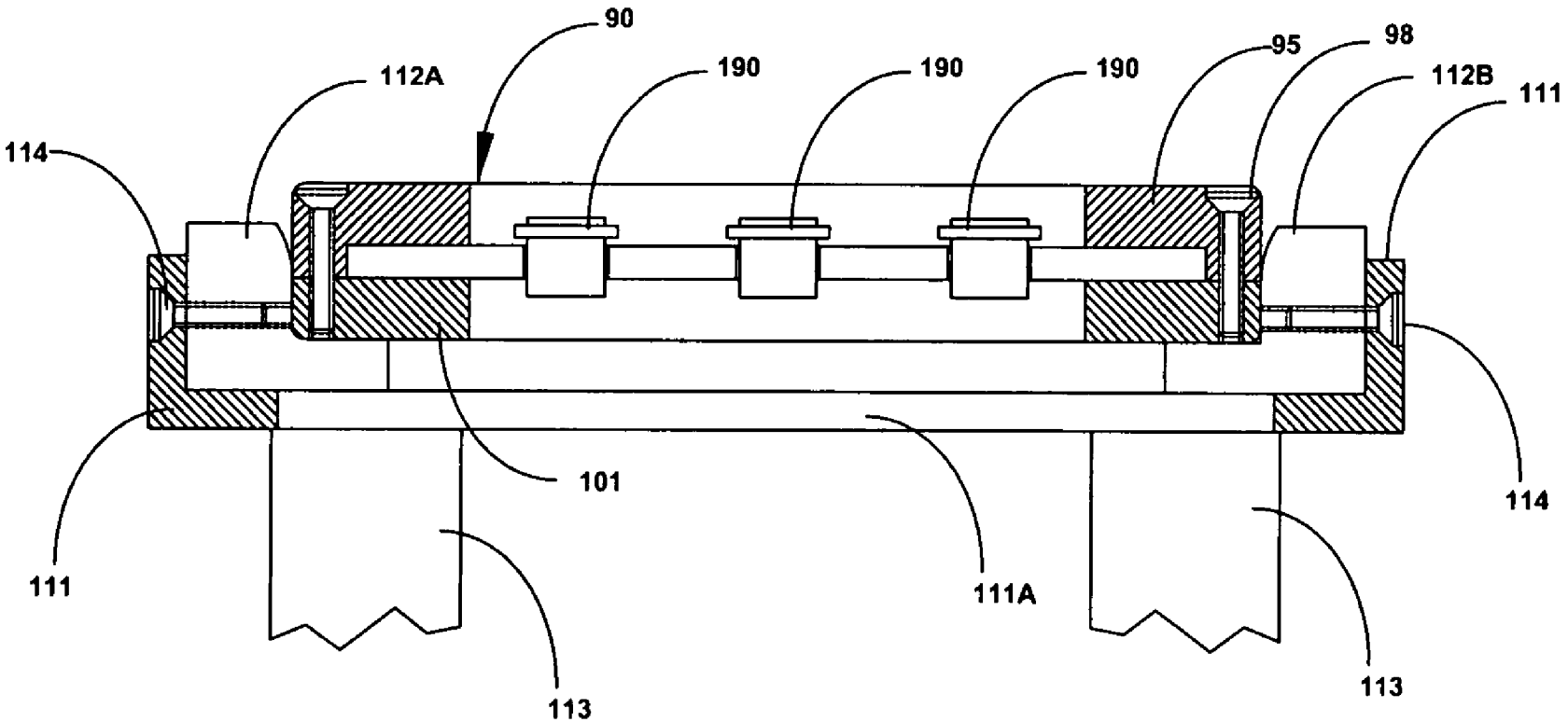
FIG. 7 is a cross sectional view taken along lines 7-7 respectively in FIG. 6.
Figure 8:
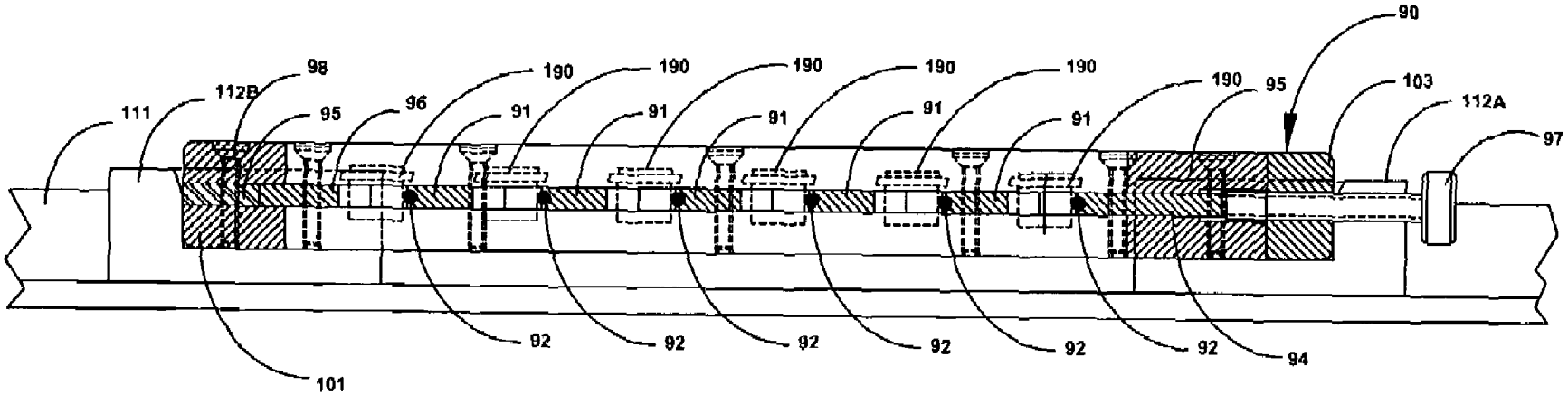
FIG. 8 is a cross sectional view taken along lines 8-8 respectively in FIG. 6.

As shown on FIG. 1 process tank 152 is straddled by plurality of support member 111 and 111A. Plurality of stand off 113 elevate plurality of support member 111 and 111A which are attached to each other in a frame like fashion to be slightly above upper extremity of process tank 152. Receiving device 90 as referred to in FIGS. 6, 7, 8 is located by plurality of locator bracket 112A and 112B permanently fastened to plurality of support member 111. Electrolyte supply pump 161 is mounted at one end internally of process tank 152 and connected to electrolyte supply line 76 having flow regulator valve 73 and electrolyte return line 75 having flow restrictor valve 72. Plurality of hermetic connector 190 is received in a grid like pattern by receiving device 90. Plurality of conducting device 130 as referred to in FIGS. 13, 14 engage with plurality of hermetic connector 190 to provide electric current to plurality of contact 190B—not shown. Upper end of plurality of conducting device 130 is solder connected to plurality of lug 44 which is solder connected to plurality of wire harness 38. Plurality of wire harness 38 is insulated and routed via plurality of clamp 39 which bundles and holds plurality of wire harness 38 in position terminating to plurality of harness connect 32 having nut 25 for making proper electric contact. Terminal board 33 incorporates plurality of harness connect 32 terminating to common conductor wire 59 being connected to the minus terminal of power supply 101—not shown. Below horizontal support plate 36 is mounted conducting device support plate 37 with plurality of stand off 35. Plurality of conducting device 130 is positioned vertically being retained by support plate 37 in coaxial alignment with plurality of hermetic connector 190 retained by receiving device 90. Horizontal support plate 36 is fastened against rear mounting plate 31 with plurality of gusset 34. Facing side of plurality of riser 172 has plurality of clamp bracket 174 at upper end vertically positioning plurality of liner shaft 175.

Figure 2:
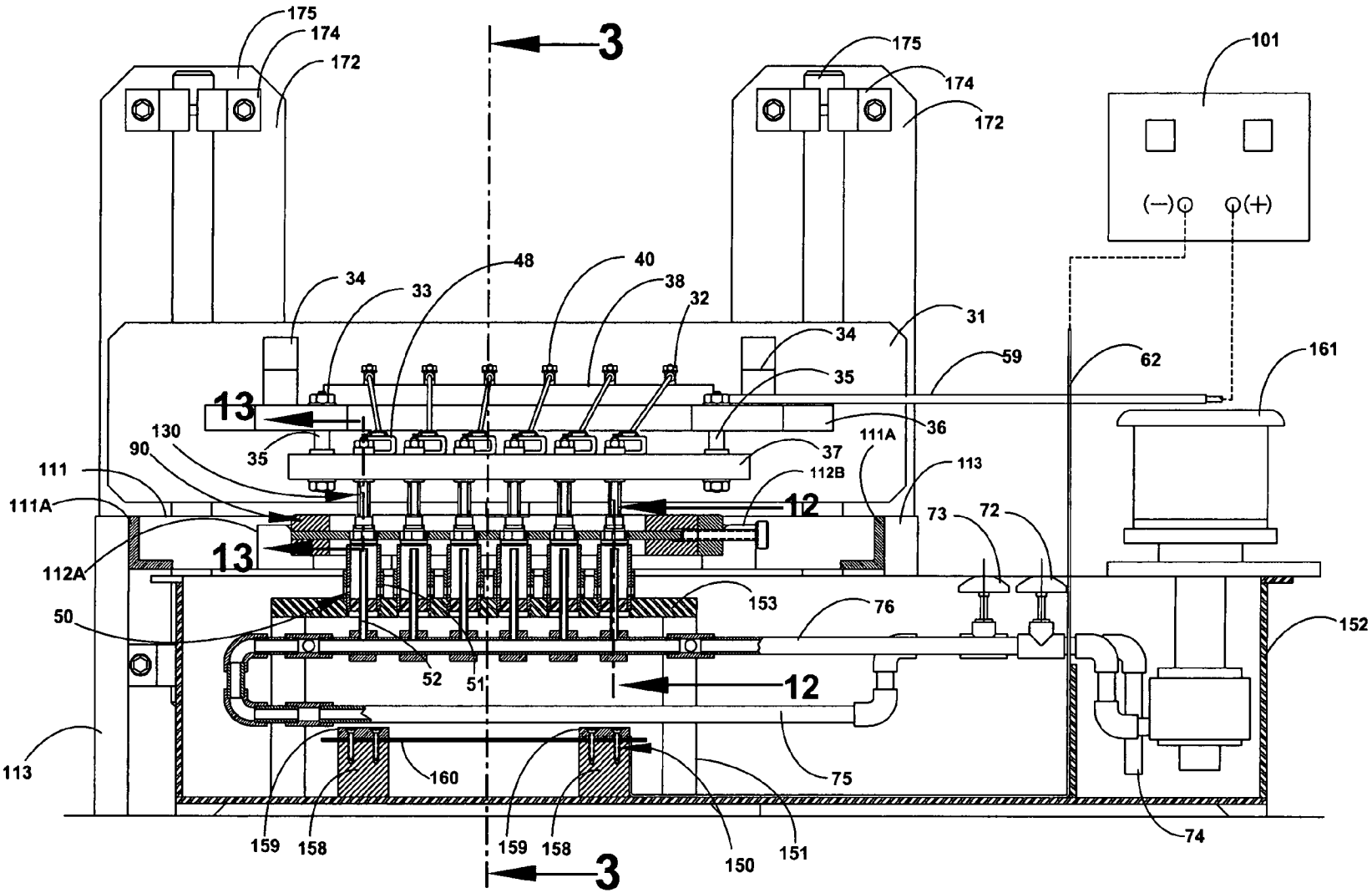
FIG. 2 is a front elevation and partial cross sectional view taken along lines 2-2 respectively in FIG. 1.
Figure 12:
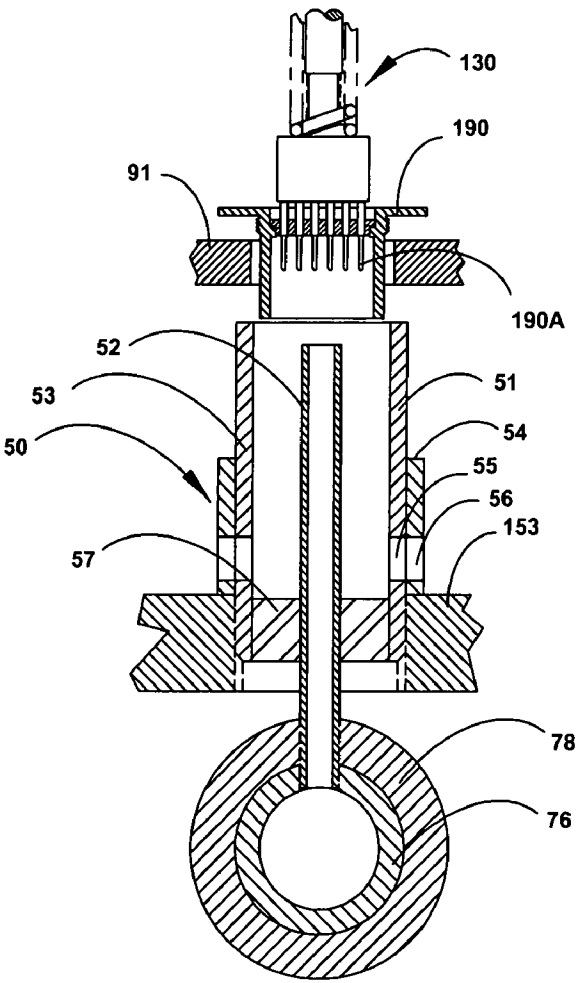
FIG. 12 is a partial cross sectional view taken along lines 12-12 respectively in FIG. 2.
Figure 13:
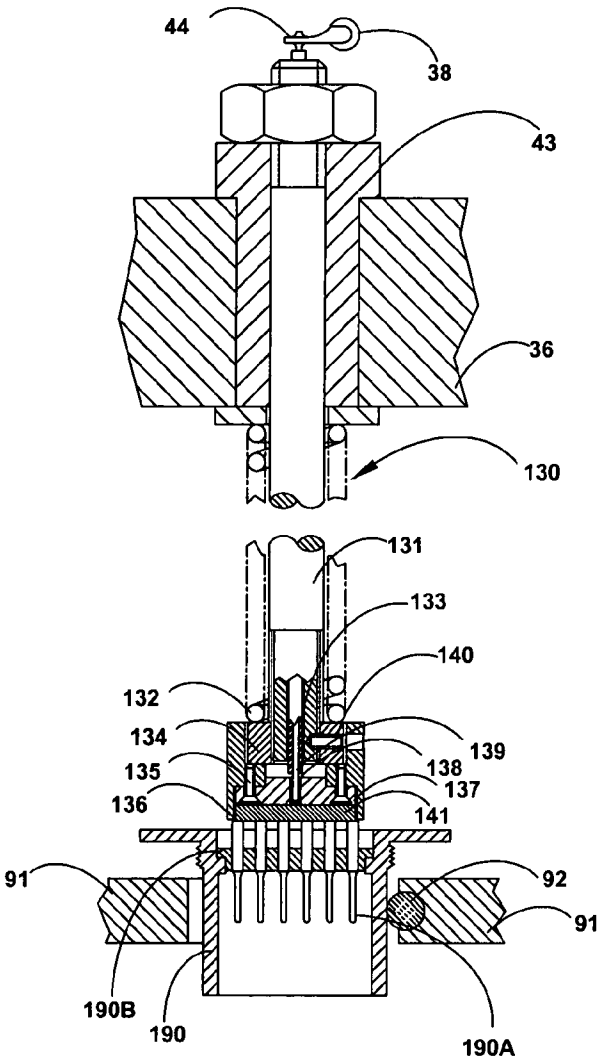
FIG. 13 is a cross sectional view of a preferred embodiment of present invention taken along lines 13-13 respectively in FIG. 2.
Figure 13A:
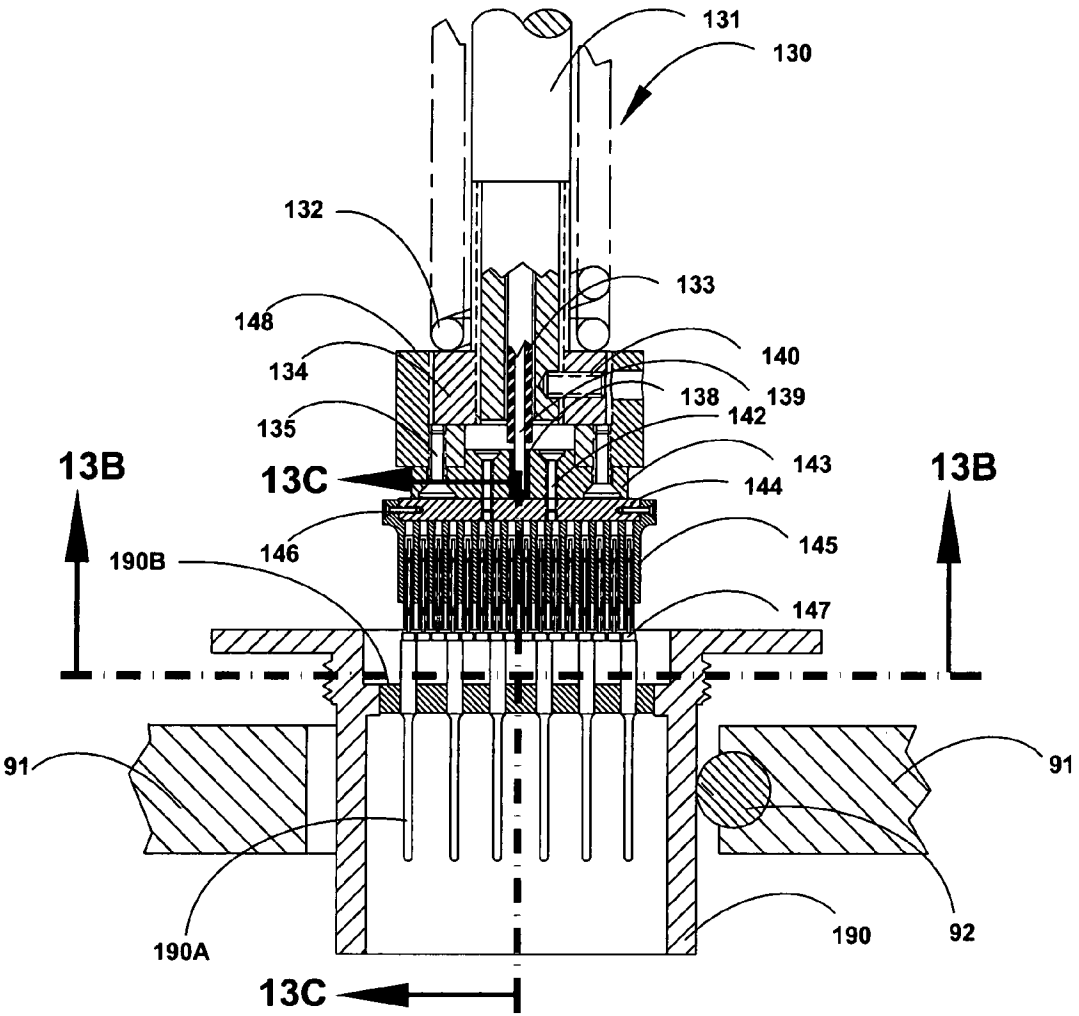
FIG. 13A is a partial cross sectional view of a preferred embodiment of present invention at close approximation taken along lines 13-13 respectively in FIG. 2.

FIG. 2 as shown is a further front elevation view of present invention. Plurality of conducting device 130 referred to in FIGS. 13, 13A is coaxially opposing and engaging with plurality of hermetic connector 190 providing electric current to plurality of contact 190B referred to in FIGS. 13, 13A, 13B, 13C. The plus side of terminal at power supply 101 sends current to anode screen 154 from which the electric current travels via electrolyte—not shown—contained in process tank 152 to plurality of contact 190B closing the electric circuit via plurality of engaged conducting device 130 and plurality of harness 38 to common conductor wire 59 connected to minus terminal of power supply 101. The volume of electrolyte dispensed and the dispersion rate determines the plating cycle and uniform thickness of the plating. This can be easily controlled with the aid of control valve 72 and 73. Facing side of plurality of riser 172 shows plurality of mounted clamp bracket 174, locating linear shaft 175. Horizontal support plate 36 with plurality of gusset 34 is mounted on front side of rear mounting plate 31. Upper end of conducting device 130 is solder connected to plurality of lug 44 which is solder connected to plurality of terminations for wire harness 38. Wire harness 38 is insulated and routed via plurality of clamp 39 which bundles and holds wire harness 38 in position terminating to plurality of harness connect 32 having the end of wire harness 38 stripped of its insulation and clamped with plurality of nut 25 to make a proper electrical connection. Terminal board 33 incorporates plurality of harness connect 32 terminating to common conductor wire 59 being connected to the minus terminal of power supply 101. Below horizontal support plate 36 is mounted conducting device support plate 37 with plurality of stand off 35. Plurality of conducting device 130 is positioned along its vertical center axis and retained by support plate 37 in coaxial alignment with plurality of hermetic connector 190 retained by receiving device 90. Horizontal support plate 36 is fastened against rear mounting plate 31 with plurality of gusset 34. Facing side of plurality of riser 172 has plurality of clamp bracket 174 at the upper end positioning plurality of liner shaft 175 along its vertical center axis. Process tank 152 is straddled by plurality of support member 111 and 111A. Plurality of stand off 113 elevate plurality of support member 111 and 111A which is attached to each other in a frame like fashion to be slightly above upper extremity of process tank 152. Receiving device 90 referred to in FIGS. 6, 7, 8 is located by plurality of locator bracket 112A and 112B permanently fastened to plurality of support member 111. Electrolyte supply pump 161 is mounted at one end internally of process tank 152 and connected to electrolyte supply line 76 having flow regulator valve 73 and electrolyte return line 75 having flow restrictor valve 72. Electrolyte pump 161 circulates electrolyte through supply line 75 via control valve 72 to plurality of jet cell 50 referred to in FIG. 12. A portion of electrolyte will exit upper extremity of plurality of jet cell 50 by being forced upwardly and dispersed into opposing cavity of plurality of hermetic connector 190 having plurality of contact 190B with any remaining volume of electrolyte to return via electrolyte return line 75 through control valve 73 to exit at drain 74. The gate position of control valve 72 and retrospectively control valve 73 determines the volume and pressure of electrolyte flowing through supply line 76 and eventually to jet cell 50. Below electrolyte return line 74 is located anode arrangement 150 referred to in FIG. 10. Anode screen 154 is retained in a horizontal plane by plurality of bracket 155 and fastened to plurality of stand off 158. Conductor wire 62 is connected to anode screen 154 with the opposite end connected to the plus terminal of power supply 101. For a proper conductance of current enabling the plating process the electrolyte level must be above anode screen 154 by a sufficient margin—not shown.

Figure 3:
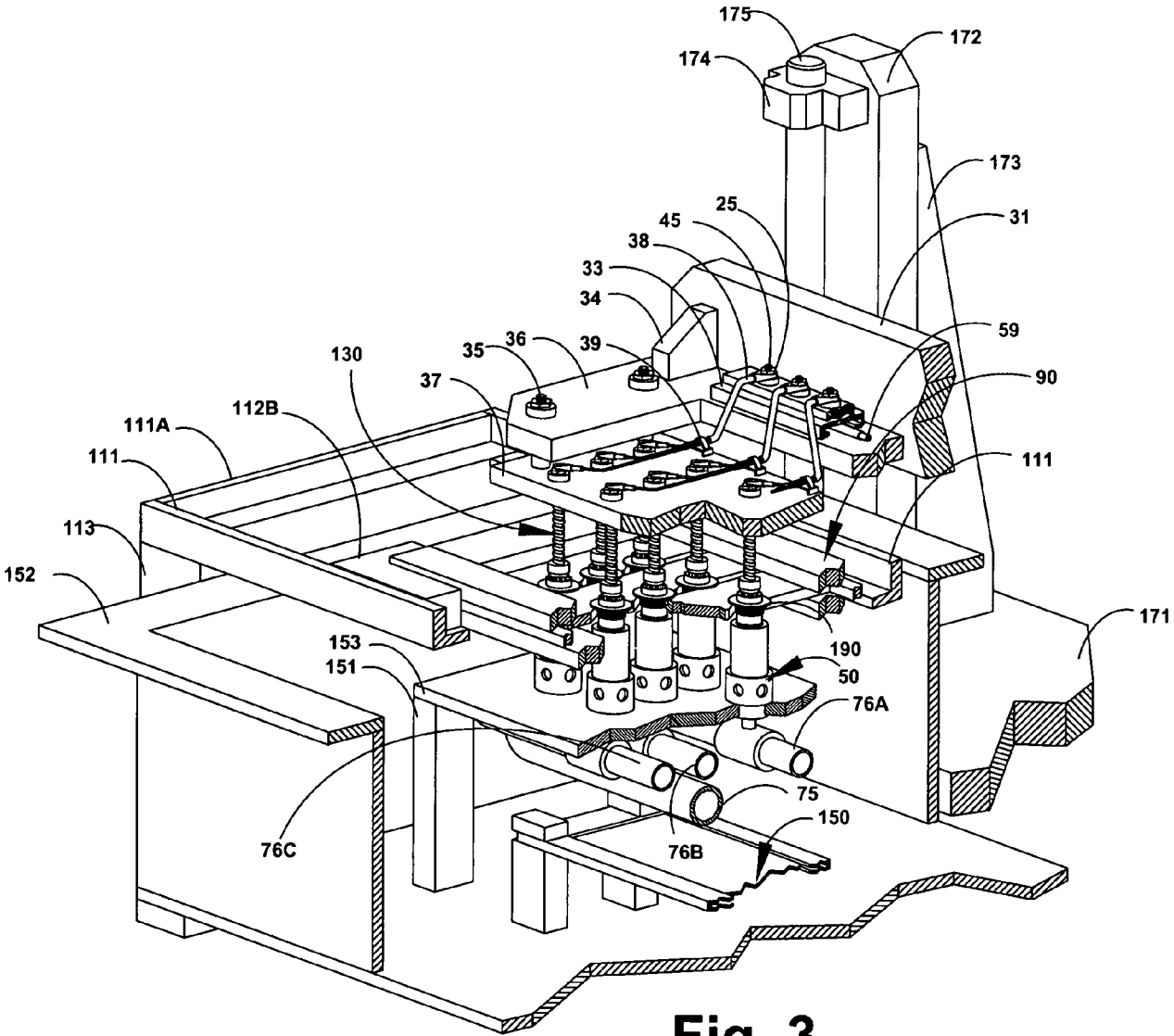
FIG. 3 is a perspective cross sectional with break away feature taken along lines 3-3 respectively in FIG. 2.

FIG. 3 shows a perspective and cross sectional view of present invention. Process tank 152 is straddled by plurality of support member 111 and 111A. Plurality of stand off 113 elevate plurality of support member 111 and 111A which are attached to each other in a frame like fashion to be slightly above upper extremity of process tank 152. Receiving device 90 as referred to in FIGS. 6, 7, 8 is located by plurality of locator bracket 112A and 112B—not shown—permanently fastened to plurality of support member 111. Plurality of hermetic connector 190 is retained in a grid like pattern by receiving device 90. Plurality of conducting device 130 referred to in FIGS. 13, 13A engages with plurality of hermetic connector 190 to provide electric current to plurality of contact 190B referred to in FIGS. 13, 13A, 13B, 13C. Upper end of plurality of conducting device 130 is solder connected to plurality of lug 44 which is solder connected to plurality of wire harness 38. Plurality of wire harness 38 is insulated and routed via plurality of clamp 39 which bundles and holds plurality of wire harness 38 in position terminating to plurality of harness connect 32 having nut 25 for making proper electric contact. Terminal board 33 incorporates plurality of harness connect 32 terminating to common conductor wire 59 being connected to the minus terminal of power supply 101—not shown. Below horizontal support plate 36 is mounted conducting device support plate 37 with plurality of stand off 35. Plurality of conducting device 130 is positioned vertically being retained by support plate 37 in coaxial alignment with plurality of hermetic connector 190 retained by receiving device 90. Horizontal support plate 36 is fastened against rear mounting plate 31 with plurality of gusset 34. Facing side of plurality of riser 172 has plurality of clamp bracket 174 at upper end retaining plurality of liner shaft 175 along its vertical center axis. Base 171 supports riser 172 with gusset 171. Plurality of jet cell 50 referred to in FIG. 12 is coaxially positioned along its vertical center axis opposing hermetic connector 190. Plurality of base of jet cell 50 is affixed to plate 153 protruding down ward to connect with electrolyte supply line 76C, 76B, 76A to enable electrolyte to disperse upwardly exiting upper extremity of plurality of jet cell 50 by being forced into opposing cavity of plurality of hermetic connector 190 having plurality of contact 190B with any remaining volume of electrolyte to return via electrolyte return line 75 and any other over flow of electrolyte disperse back into process tank 152. Plate 153 is rigidly supported by and fastened to plurality of stand off 151 straddling anode arrangement 150 referred to in FIG. 10.

Figure 4:
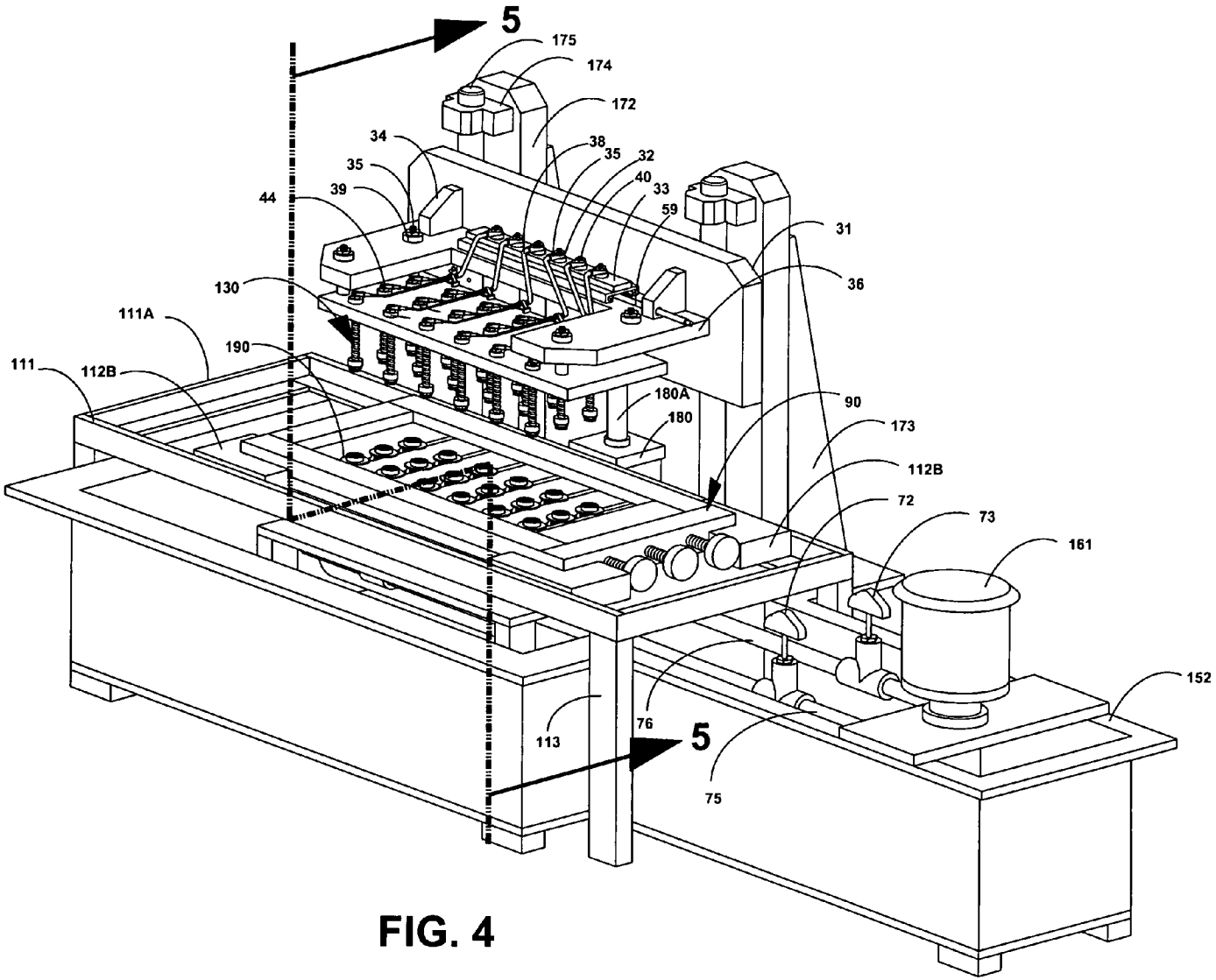
FIG. 4 is a perspective view of present invention showing a process tank with a receiving device having hermetic connector disengaged with conducting device.

Another perspective view of present invention is shown in FIG. 4. Process tank 152 is straddled by plurality of support member 111 and 111A. Plurality of stand off 113 elevate plurality of support member 111 and 111A which are attached to each other in a frame like fashion to be slightly above upper extremity of process tank 152. Receiving device 90 referred to in FIGS. 6, 7, 8 are located by plurality of locator bracket 112A and 112B permanently fastened to plurality of support member 111. Electrolyte supply pump 161 is mounted at one end internally of process tank 152 and connected to electrolyte supply line 76 having flow regulator valve 73 and electrolyte return line 75 having flow restrictor valve 72. Plurality of hermetic connector 190 is retained in a grid like pattern by receiving device 90. Plurality of conducting device 130 referred to in FIGS. 13, 13A is in an upward position and disengaged from hermetic connector 190 opposing each other in coaxial alignment along vertical center axis. Linear actuator 180 is showing reciprocating element 180A in fully upwardly extended position. Upper end of plurality of conducting device 130 is solder connected to plurality of lug 44 which is solder connected to plurality of wire harness 38. Plurality of wire harness 38 is insulated and routed via plurality of clamp 39 which bundles and holds plurality of wire harness 38 in position terminating to plurality of harness connect 32 having nut 25 for making proper electric contact. Terminal board 33 incorporates plurality of harness connect 32 terminating to common conductor wire 59 being connected to the minus terminal of power supply 101—not shown. Below horizontal support plate 36 is mounted conducting device support plate 37 with plurality of stand off 35. Plurality of conducting device 130 is positioned vertically being retained by support plate 37 in coaxial alignment with plurality of hermetic connector 190 retained by receiving device 90. Horizontal support plate 36 is fastened against rear mounting plate 31 with plurality of gusset 34. Facing side of plurality of riser 172 has plurality of clamp bracket 174 at upper end vertically positioning plurality of liner shaft 175.

Figure 5:
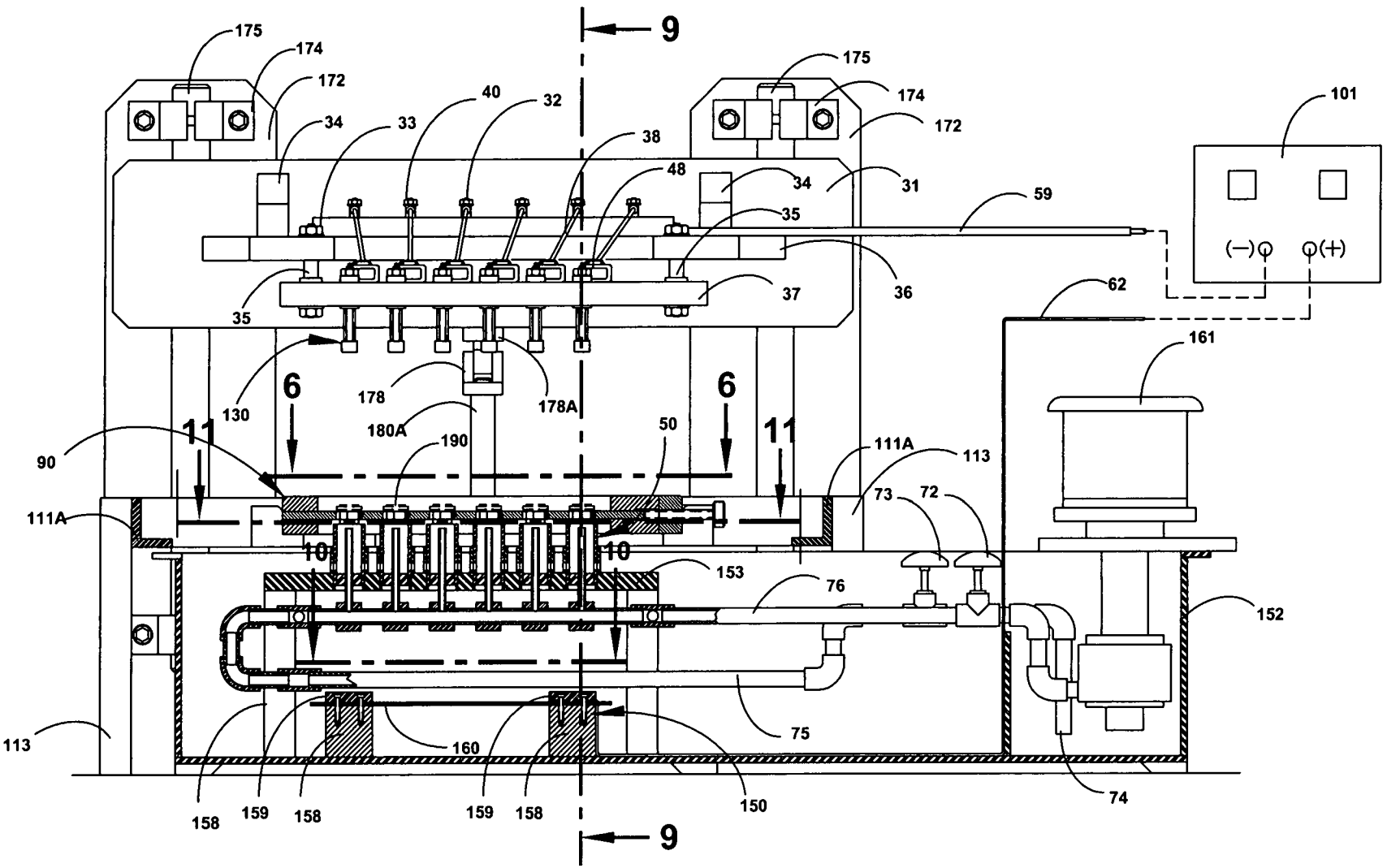
FIG. 5 is a front elevation and partial cross sectional view taken along lines 5-5 respectively in FIG. 4.

FIG. 5 as shown is a further front elevation view of present invention. Plurality of conducting device 130 referred to in FIGS. 13, 13A is coaxially opposing and disengaged with plurality of hermetic connector 190. Linear actuator 180 is showing reciprocating element 180A in full upwardly extended position having clevis 178 pivotally connected with bracket 178A fastened to lower extremity of rear mounting plate 31. All other elements in this view are showing in complete duplication to FIG. 1. For this reason labeling is identical to FIG. 2 and should be referred to as such.

A plan view of receiving device 90 is shown in FIG. 6. in specific being retained in a horizontal plane by plurality of locator bracket 112A and retrospectively plurality of bracket 112B aforesaid fastened to plurality of support member 111. Stop plate 96 is fastened to upper plate 95 and lower plate 101—not shown—with plurality of counter sink screw 100. Plurality of slider plate 91 is movable in a horizontal plane being sandwiched between upper plate 91 and lower plate 101—not shown—and captured on its sides by protruding lip of upper plate 91—not shown. V configuration of front edge of plurality of slider plate 91 retains plurality of hermetic connector 190 in a horizontal plane as such that plurality of contact 190B—not shown—is directed downward in perpendicular plane to said horizontal plane. Rear edge of plurality of slider plate 91 has o-ring type of strip 92 inserted along a majority of length of rear edge partially protruding from edge surface. Strip 92 is of flexible and durable material with the ability to absorb clamping force applied against hermetic connector 190 not to incur any damage by maintaining proper clamping pressure to rigidly retain plurality of hermetic connector 190 during plating process and handling of receiving device 90. End bracket 103 is fastened to edge of upper plate 95 with plurality of counter sinks screw 98 to provide proper rigidity for plurality of clamp screw 97 for exertion of clamping pressure onto plurality of stacked slider plate 91 via slider plate clamp 94 and thus plurality of hermetic connector assembly 190. Plurality of slider plate 91 may be applied in various configurations for adaptability to various sizes of hermetic connector assembly 190. Plurality of elements for receiving device 90 with exception to plurality of hermetic connector assembly 190 are of a material to be durable and inert to the repeated exposure of corrosive media such as of acidic and caustic nature and to be electrically non conductive. Most note worthy to mention is the intended application and exposure of receiving device 90 to pre plate processes specifically caustic cleaning and acidification thus eliminating excessive handling for plurality of hermetic connector 190 throughout plating process in its entirety.

Another cross sectional view of receiving device 90 is shown in FIG. 7. Plurality of hermetic connector 190 is being retained in a horizontal plane by plurality of slider plate 91 as such that plurality of contact 190B—not shown—is directed downwardly in perpendicular plane to said horizontal plane. Plurality of slider plate 91 is being sandwiched between upper plate 95 and lower plate 101 and retained on its side by protruding lip of upper plate 95. Receiving device 90 is being retained in a horizontal plane by plurality of locator bracket 112A and retrospectively plurality of bracket 112B aforesaid fastened to plurality of support member 111 with plurality of counter sink screw 114. Plurality of cross member 111 and retrospectively 111A is supported by plurality of stand off 113.

A further cross sectional view of receiving device 90 along the longitudinal axis is shown in FIG. 8. in specific being retained in a horizontal plane by plurality of locator bracket 112A and retrospectively plurality of bracket 112B aforesaid fastened to plurality of support member 111. Stop plate 96 is fastened to upper plate 95 and lower plate 101—not shown—with plurality of counter sink screw 100. Plurality of slider plate 91 is movable in a horizontal plane being sandwiched between upper plate 91 and lower plate 101—not shown—and captured on its sides by protruding lip of upper plate 91—not shown. V configuration of front edge of plurality of slider plate 91 retains plurality of hermetic connector 190 in a horizontal plane as such that plurality of contact 190B—not shown—is directed downwardly in perpendicular plane to said horizontal plane. Rear edge of plurality of slider plate 91 has o-ring type of strip 92 inserted along a majority of length of rear edge partially protruding from edge surface. Strip 92 is of flexible and durable material with the ability to absorb clamping force applied against hermetic connector 190 not to incur any damage by maintaining proper clamping pressure to rigidly retain plurality of hermetic connector 190 during plating process and handling of receiving device 90. End bracket 103 is fastened to edge of upper plate 95 with plurality of counter sinks screw 98 to provide proper rigidity for plurality of clamp screw 97 for exertion of clamping pressure onto plurality of stacked slider plate 91 via slider plate clamp 94 and thus plurality of hermetic connector assembly 190. Plurality of slider plate 91 may be applied in various configurations for adaptability to various sizes of hermetic connector assembly 190. Plurality of elements for receiving device 90 with exception to plurality of hermetic connector assembly 190 are of a material to be durable and inert to the repeated exposure of corrosive media such as of acidic and caustic nature and to be electrically non conductive. Most note worthy to mention is the intended application and exposure of receiving device 90 to pre plate processes specifically caustic cleaning and acidification thus eliminating excessive handling for plurality of hermetic connector 190 throughout plating process in its entirety.

Figure 9:
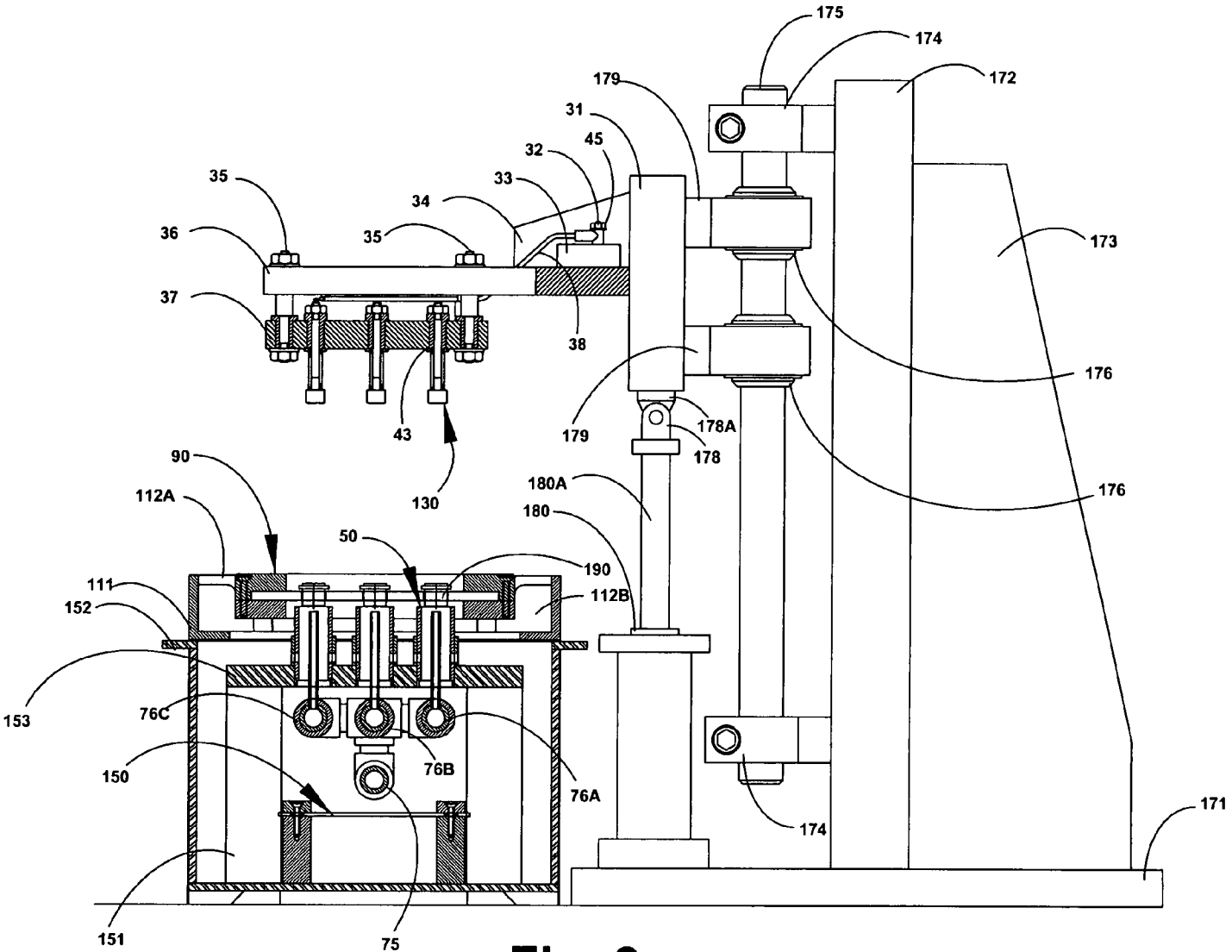
FIG. 9 is a cross sectional view taken along lines 9-9 respectively in FIG. 5.

FIG. 9 represents a cross sectional side elevation of present invention. Process tank 152 is straddled by plurality of support member 111 and 111A. Plurality of stand off 113 elevate plurality of support member 111 and 111A which are attached to each other in a frame like fashion to be slightly above upper extremity of process tank 152. Receiving device 90 as referred to in FIGS. 6, 7, 8 is located by plurality of locator bracket 112A and 112B—not shown—permanently fastened to plurality of support member 111. Plurality of hermetic connector 190 is received in a grid like pattern by receiving device 90. Plurality of conducting device 130 referred to in FIGS. 13, 13A engages with plurality of hermetic connector 190 to provide electric current to plurality of contact 190B referred to in FIGS. 13, 13A, 13B, 13C. Upper end of plurality of conducting device 130 is solder connected to plurality of lug 44 which is solder connected to plurality of wire harness 38. Plurality of wire harness 38 is insulated and routed via plurality of clamp 39 which bundles and holds plurality of wire harness 38 in position terminating to plurality of harness connect 32 having nut 25 for making proper electric contact. Terminal board 33 incorporates plurality of harness connect 32 terminating to common conductor wire 59 being connected to the minus terminal of power supply 101—not shown. Below horizontal support plate 36 is mounted conducting device support plate 37 with plurality of stand off 35. Plurality of conducting device 130 is positioned vertically being retained by support plate 37 in coaxial alignment with plurality of hermetic connector 190 retained by receiving device 90. Horizontal support plate 36 is fastened against rear mounting plate 31 with plurality of gusset 34. Plurality of linear shaft 175 is aligned along the vertical axis with plurality of rear mounted clamp bracket 174 to front face of riser 172. Plurality of linear bearing 176 is retained by plurality of bracket 179 fastened to rear mounting plate 31. Linear actuator 180 is showing reciprocating element 180A in full upwardly extended position having clevis 178 pivotally connected with bracket 178A fastened to lower extremity of rear mounting plate 31. Horizontal support plate 36 is fastened to front side of rear mounting plate 31 with plurality of gusset 34. Plurality of upper portion of conductor 130 is slide able along its vertical centerline with plurality of liner bushing 43 in a reciprocating fashion. This is to assure that proper contact pressure is applied to plurality of hermetic connector 190 enabling conductance of current to plurality of contact 190A—not shown—compensating as such that variation in vertical distance of connector 190 is compensated for without impairing proper conductance of current to plurality of contact 190A—not shown. Aforesaid is a critical feature to the function ability of the plating as it enables the plating of various configured hermetic connector within the same plating cycle therefore yielding an economical plating process with assurance for zero defects. Base 171 supports riser 172 with gusset 173. Plurality of jet cell 50 referred to in FIG. 12 is coaxially and vertically positioned opposing hermetic connector 190. Plurality of base of jet cell 50 is affixed to plate 153 protruding downwardly to connect with electrolyte supply line 76C, 76B, 76A to enable electrolyte to disperse upwardly exiting upper extremity of plurality of jet cell 50 by being forced into opposing cavity of plurality of hermetic connector 190 having plurality of contact 190B with any remaining volume of electrolyte to return via electrolyte return line 75 and any other over flow of electrolyte disperse back into process tank 152. Plate 153 is rigidly supported by and fastened to plurality of stand off 151 straddling anode arrangement 150 referred to in FIG. 10.

Figure 10:
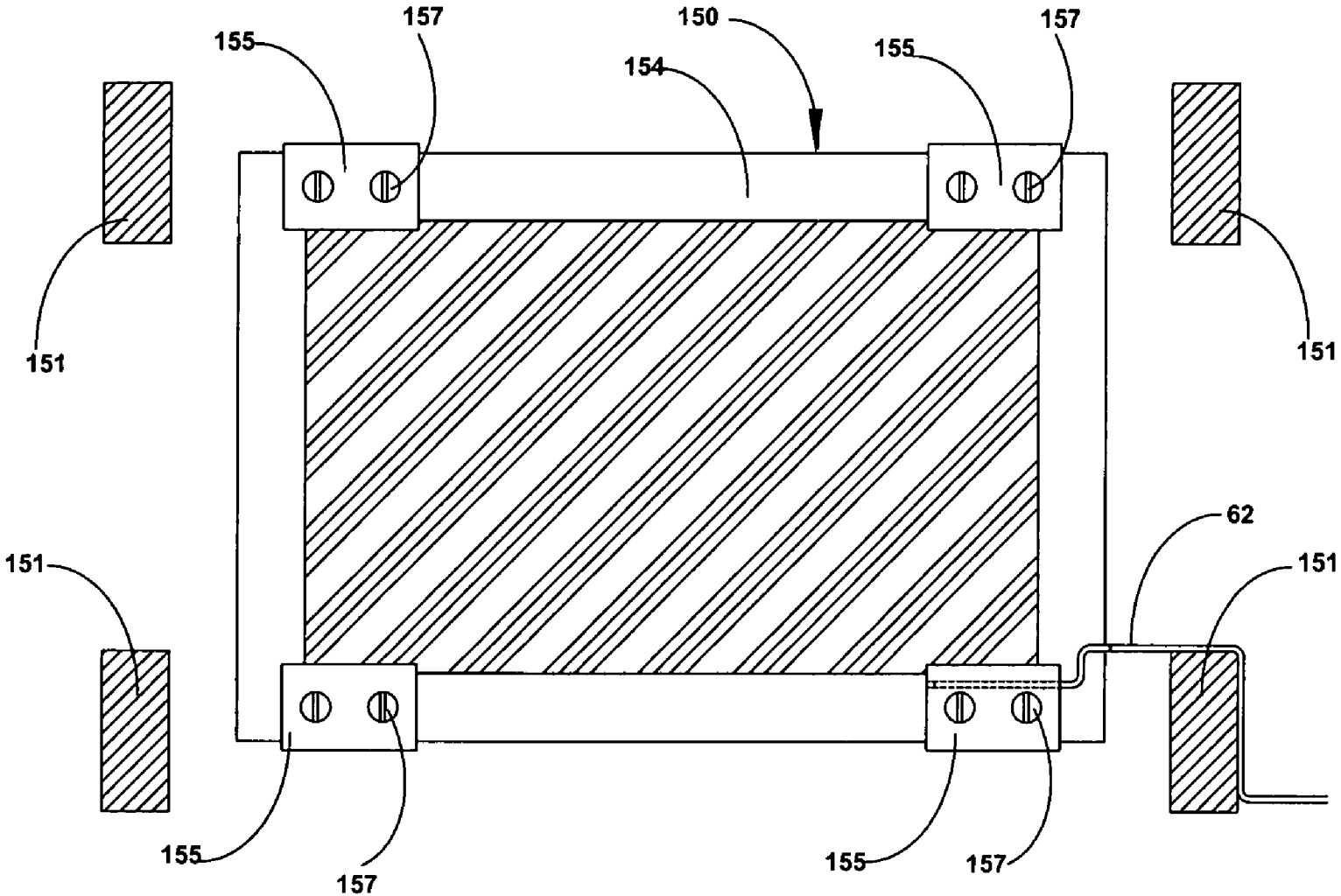
FIG. 10 is a plan view taken along lines 10-10 respectively in FIG. 5.

FIG. 10 shows a plan view of anode arrangement 150. Anode screen 154 is attached with plurality of hold down bracket 159 with plurality of counter sink screw 157. Conductor wire 62 is clamped in between anode screen 154 and anode bracket 155 to make proper electrical contact with anode screen 154. Plurality of anode bracket 155 and plurality of counter sink screw 157 and plurality of stand off 158—not shown—is of electric non-conductive material. Plurality of leg 151 of plate 153—not shown—is positioned to straddle anode screen 154.

Figure 11:
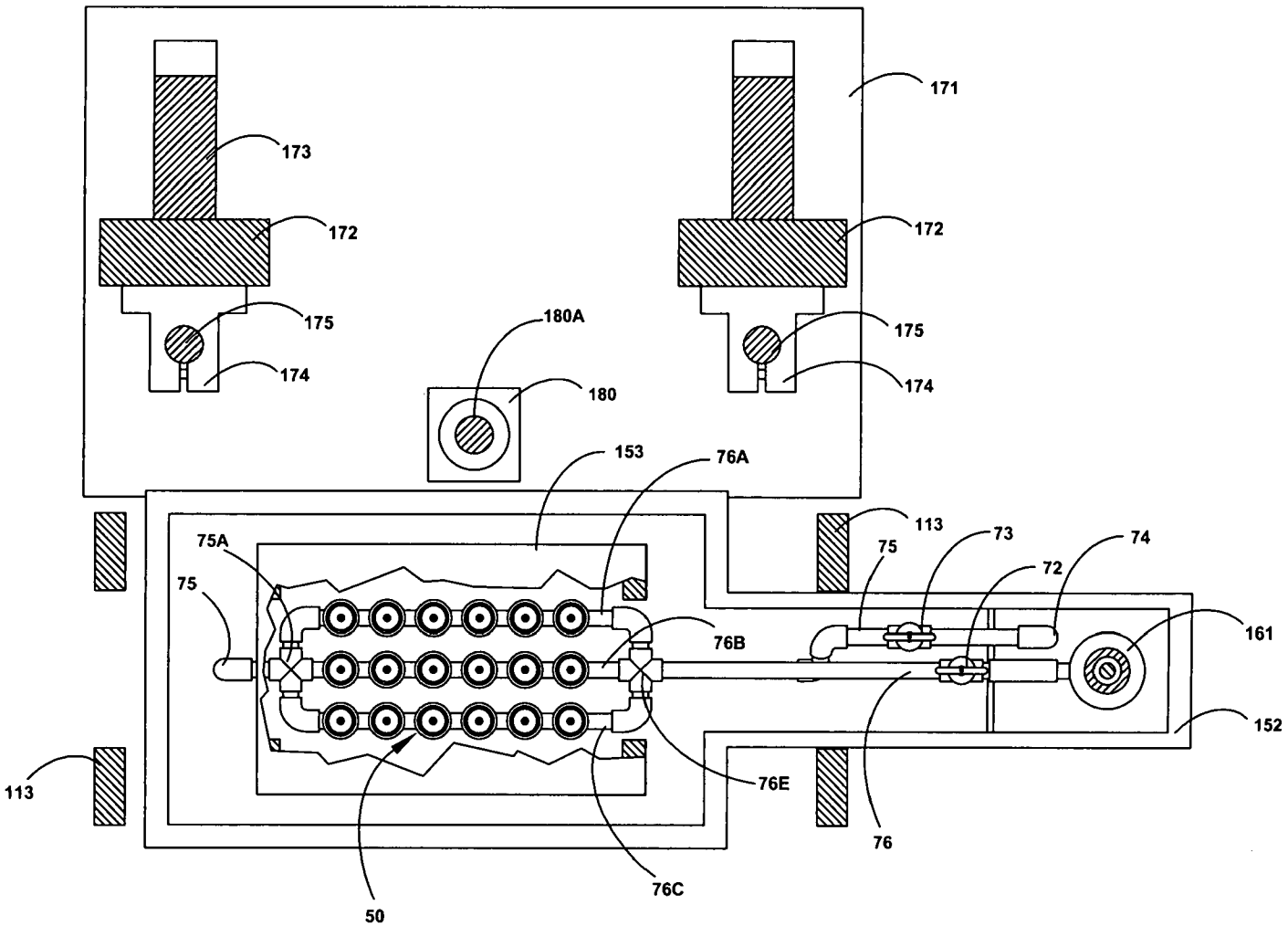
FIG. 11 is a cross sectional view with breakaway feature taken along lines 11-11 respectively in FIG. 5.

FIG. 11 shows a cross sectional plan view of embodiment of present invention. Electrolyte supply line 76 diverges into supply line 76A, 76B, 76C at intersect point 76E having plurality of jet cell 50 referred to in FIG. 12 threaded into upper segment to enable free flow of electrolyte for exiting at upper extremity of jet cell 50. Supply line 76A, 76B, 76C are merging at opposite end at intersect point 75A to combine into electrolyte return line 75. Support plate 153 referred to in cut away feature has permanently attached plurality of jet cell 50. Electrolyte flow control valve 72 is mounted directly in line with electrolyte supply line 76. Return flow control valve 73 is mounted directly in line with electrolyte return line 75. Electrolyte pump 161 supplies electrolyte solution to electrolyte supply line 76 via control valve 72 to supply line 76A, 76B, 76C for it to exit through jet cell 50 and for any portion of electrolyte solution to return via electrolyte return line 75 through control valve 73 to exit at drain 74 into electrolyte containment tank 152. Base plate 171 supports plurality of riser 172 with plurality of gusset 173. Front side of plurality of riser 172 has attached to it plurality of split clamp bracket 174, which locates linear shaft 175 in precise vertical and upright position. Linear actuator 180 with shaft 180A is mounted on base plate 171 along the vertical axis. Plurality of stand off 113 straddle process tank 152 supporting plurality of frame member 111, 111A—not shown.

FIG. 12 shows a cross sectional elevation view of jet cell 50 having hermetic connector 190 with plurality of contact 190A coaxial aligned along vertical center axis and positioned directly above upper extremity of jet cell 50. At opposite end of hermetic connector 190 conductor 130 referred to in FIGS. 13, 13A is engaging with plurality of opposite end of contact 190A. Along vertical center line of jet cell 50 is nozzle 52 for electrolyte ejection. Containment shell 53 is threaded into threaded holes provided for in manifold support 153. Electrolyte over flow adjustment sleeve 54 is mounted over electrolyte containment shell 53 in slip fit fashion. Thus by rotating adjustment sleeve 54 positions hole 56 in relation to drain hole 55 in containment shell 53 providing sufficient overflow volume for electrolyte—not shown—when exiting upper extremity of nozzle 52. Plug 57 provides a permanent seal preventing electrolyte draining back into containment tank 152. Nozzle 52 centrally penetrates plug 57 and is threaded through support sleeve 78 into electrolyte supply line 76A. Clamping slider plate 91 is retaining hermetic connector assembly 190 in coaxial alignment along vertical centerline with contactor 130 and nozzle 52. Electrolyte to be dispensed from nozzle 52 will flood and submerge cavity of hermetic connector assembly 190 providing necessary electrolyte dispersion across surface of plurality of contact 190A. Flow rate of electrolyte exiting nozzle 52 determines degree of plating efficiency and subsequently overall thickness distribution of plating across surface of plurality of contact 190A.

FIG. 13 shows a cross sectional view of contactor 130 at close approximation. Contact pad 141 consisting of a pliable elastic and electric conductive material is mounted onto the lower extremity of conductor adapter 137. Conductor copper rod 139 is soldered into cavity 138 in center of conductor adapter 137. Insulator 133 through its entire length insulates copper rod 139. Conductor pad 141 with conductor adapter 137 and conductor copper rod 139 are highly conductive enabling proper conductance of electric current. Plunger body 131 contains insulator 133 and copper rod 139 for its entire length along its center axis. Retainer ring 134 is screwed onto the threaded end of plunger body 131. Retainer ring 134 is locked into position by setscrew 140. Conductor adapter 137 is fastened onto inner shoulder of contactor housing 148 with counter sink screw 135. Compression spring 132 rests against retainer ring 134 applying pressure on contact 190A of hermetic connector assembly 190. Contact pad 141 subsequently pushes against plurality of contact 190A with its plasticity adapting to ensure that proper engagement with plurality of contact 190A will provide a low resistance electrical connection for efficient current conductance to plurality of contact 190A. Variability of length of contacts however minute it may be in variation within contact array will result in upper extremity of plurality of contacts not to be in the same horizontal plane to each other within hermetic connector assembly. Aforesaid is of consequence enough that to date no other method had been developed industry wide for eliminating the individual wire wrapping of any hermetic connector type or configuration. A high-density high fibrous graphite mat easily to be obtained and commercially available at certain thickness provides the electrical conductivity and sufficient plasticity for contact pad 141 to assure that plurality of upper extremity of contact 190A is engaged properly with contact pad 141 providing superior electrical conductivity from contacts. Aforesaid also demonstrates the great advantage of embodiment of present invention virtually eliminating a great deal of labor required for wire wrapping individual contact 190A additionally enabling an efficient and defect free plating process for hermetic connector assembly 190 or any other hermetic connector assembly per se. Hermetic connector 190 is held in locked position by clamping slider plate 91 and strip 92 inserted into edge of clamping slider plate 91. Configuration of contact pad 141 and the proper coaxial alignment with hermetic connector 190 and contactor 130 warrants that outer shell 190B is electrically insulated consequently no plating will deposit onto shell 190B during plating cycle. Upper portion of plunger body 131 is slide able along its vertical centerline with plurality of liner bushing 43 in a reciprocating fashion. This is to assure that proper contact pressure is applied to plurality of hermetic connector 190 enabling conductance of current from plurality of contact 190A as such that variation in vertical distance of connector 190 is compensated for without impairing proper conductance of current from plurality of contact 190A. Aforesaid is a critical feature to the proper application of the plating as it enables the plating of various configured hermetic connector within the same plating cycle therefore yielding a very economical plating process with assurance for zero defects. Upper extremity of conducting rod 138 has lug 44 terminating to harness 38 as such providing low resistance electric conductivity with pad 141.

FIG. 13A shows a cross sectional elevation view at close approximation of another embodiment of present invention. Contact pad 141 in contactor 130 referred to in FIG. 13 has been substituted with plurality of pogo contact 147 inserted with a slight press fit into pogo adapter plate 145. Aforesaid is to demonstrate a further embodiment of present invention viewed as a further method toward universal adaptability of contactor 130 enabling the plating of many differently configured and in size hermetic connector. It is noteworthy to mention that pogo adapter plate 145 is electrically conductive thus to enable plurality of pogo contact 147 to conduct desired current upon engagement with contact 190A. Retrospectively pogo adapter 145 is tightly connected with electrical conductive conductor plate 144 with plurality of mounting screw 146. Conductor plate 144 is connected with conductor adapter 143 with plurality of hold down screw 142 whereas conductor copper rod 139 is soldered into cavity 138 in center of conductor adapter 143. Plunger body 131 contains insulator 133 and conductor copper rod 139 for the entire length along center axis. Retainer ring 134 is screwed onto the threaded end of plunger body 131 and is locked into position by setscrew 140. Conductor adapter 143 is fastened onto inner shoulder of contactor housing 148 with counter sink screw 135. Compression spring 132 rests against retainer ring 134 thus applying pressure opposing upper extremity for plurality of contact 190A transmitted via lower extremity of plurality of pogo contact 147 towards proper engagement with plurality of contact 190A of hermetic connector 190. Plurality of pogo contact 147 subsequently engages with upper extremity of plurality of contact 190A for proper conductance of electric current. Hermetic connector 190 is held in locked position by v configuration of clamping slider plate 91 and strip 92 inserted into edge of opposing clamping slider plate 91 with hermetic connector 190 front end or engagement end presented to plurality of pogo contact 147. As such all external surfaces for plurality of contact 190A other than enclosed by glass insulator 190B of rear end or contact end of hermetic connector 190 are being plated exclusively. Array of plurality of pogo contact 147 is configured in an arrangement to provide engagement with plurality of contact 190A with not less than one each pogo contact 147 per one each hermetic connector contact 190A as an absolute. Afore said demonstrates the great advantage of this embodiment of present invention virtually eliminating a great portion of labor required for wire wrapping individual contact 190A additionally enabling an efficient and defect free plating process for hermetic connector assembly 190 or any other hermetic connector assembly per se. Configuration of pogo adapter plate 141 and the proper coaxial alignment with hermetic connector 190 and contactor 130 warrants that outer shell 190B is electrically insulated consequently no plating will deposit onto shell 190B during plating cycle.

Figure 13B:
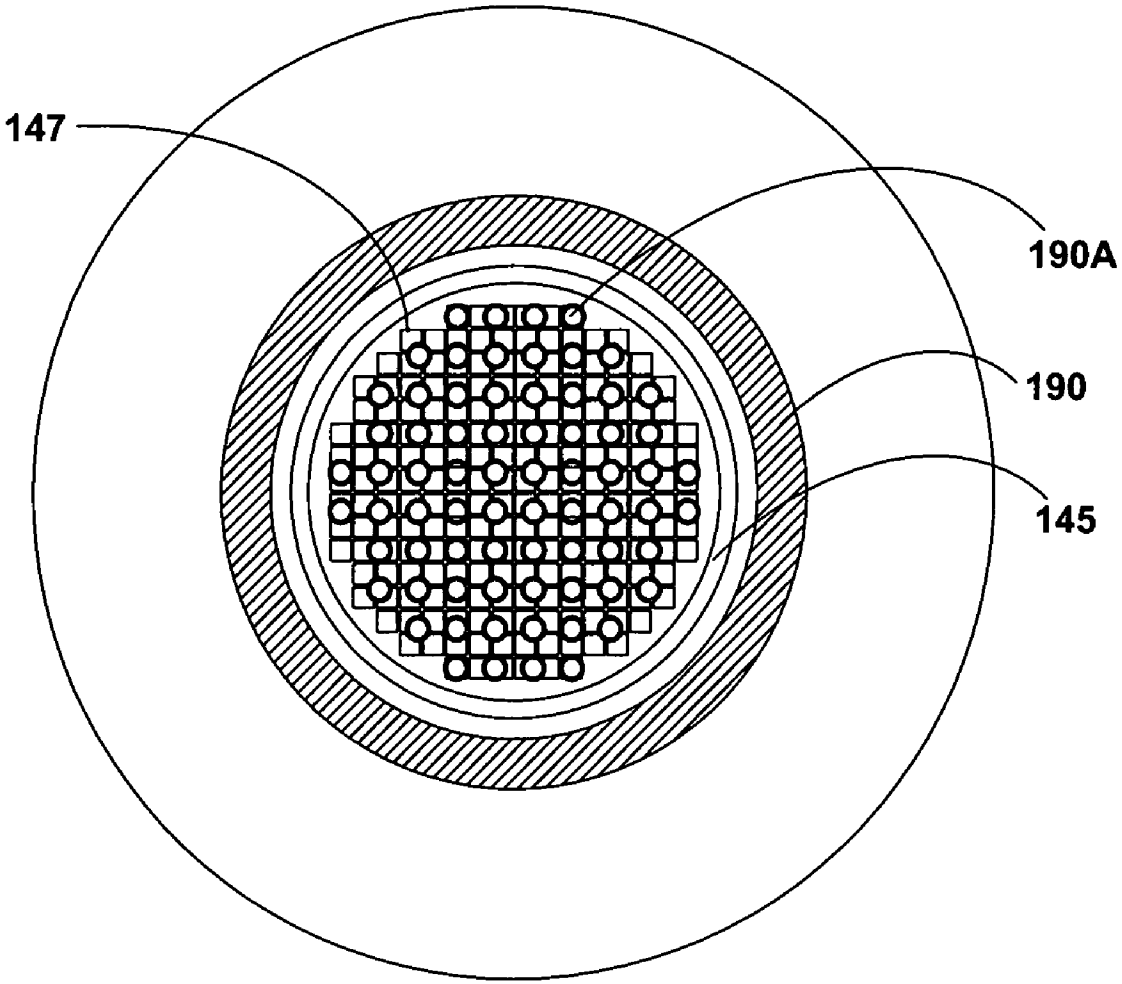
FIG. 13B is a cross sectional view taken along lines 13B-13B respectively in FIG. 13A.

FIG. 13B shows a cross sectional plan view of embodiment referenced in FIG. 13A of present invention at close approximation. The shape of outer extremity of plurality of pogo contact head 147F center distance of pogo contact 147 referred to in FIG. 13A between each other and number of pogo contact 147 installed into pogo adapter 145 is sufficient to provide universal and complete and simultaneous engagement to plurality of contact 190A for proper conductance of electric current.

Figure 13C:
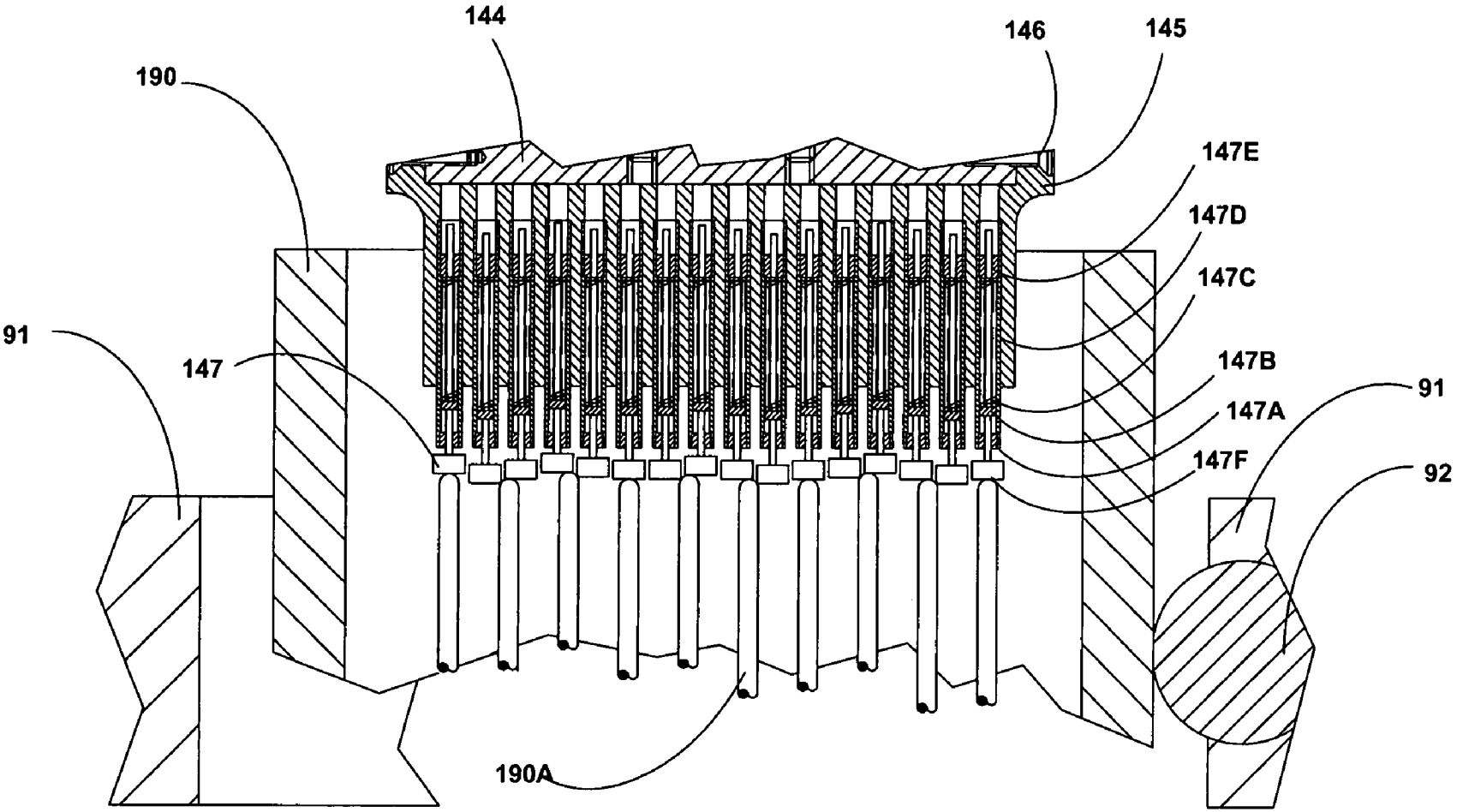
FIG. 13C is a cross sectional view at close approximation taken along lines 13C-13C respectively in FIG. 13A.

A close approximation and cross sectional elevation view of engagement mechanism between plurality of pogo contact 147 and connector contact 190A is shown on FIG. 13C. As much as it is a fact that hermetic connectors are manufactured to many different configurations specifically containing many different numbers and sizes of contacts per individual connector assembly consequentially it is of great importance to an efficient and cost effective plating process that pogo contacts are enabling the defect free plating of many differently configured contact arrays contained in hermetic connector specifically size, number and center distance of contacts in one plating cycle. Variability of length of contacts however minute it may be within each other will result in upper extremity of contacts not to be in the same horizontal plane throughout in hermetic connector assembly. Plurality of pogo contact 147 provides superior electrical conductivity in addition to having the capability to adjust to any height variances for plurality of hermetic connector contact 190A further providing assurance that plurality of hermetic connector contact 190A is plated uniformly without exception and in its entirety. Also most note worthy to mention is that this view shows the importance of the arrangement and design of plurality of pogo contact head 147F in relation to plurality of connector contact 190A assuring proper engagement at minimal electrical contact resistance at point of engagement with plurality of contact 190A. Additionally overall diameter of pogo adapter 145 is to be of sufficient size to prevent engagement of outer extremity of pogo adapter 145 with opposing inner extremity of hermetic connector 190. Afore said also demonstrates the great advantage of embodiment of present invention virtually eliminating a major portion of labor required for wire wrapping individual contact 190A and providing an efficient and defect free plating process for hermetic connector 190 or any other hermetic connector assembly per se. Hermetic connector 190 is held in locked position by clamping slider plate 91 and strip 92 inserted into edge of clamping slider plate 91. Construction of pogo contact 147 which are commercially available in many different configurations and sizes is specifically accomplished to provide proper engagement with contact 190A as such compensating for plurality of contact 190A at various lengths within the array of hermetic connector 190. Contact plunger 147A is centrally located and precision guided by retainer end bushing 147A and retainer end bushing 147E. Shoulder 147B of pogo contact 147A retains compression spring 147C, which at its opposing end is retained by retainer end bushing 147E. Liner 147D is assembled into hole provided for in pogo adapter 145.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specifications as including more than one meaning, then its use must be understood as being generic to all possible meanings supported by the specifications and by the word or words describing the element. The definitions of the words or elements of the embodiments of the herein described invention and its related embodiments not described are, therefore, in this specifications to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim. Changes from the claimed subject matter as viewed by a person with ordinary skill in the art, not known or later devised, are expressly contemplated as being equivalents within the scope of the invention and its various embodiments. Therefore, obvious substitutions now or later known to one with ordinary skill in the art defined to be within the scope of the defined elements. The invention and its various embodiments are thus to be understood to include what is specifically illustrated and described above, what is conceptually equivalent, what can obviously substituted, and also what essentially incorporates the essential idea of the invention. While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. An electroplating apparatus for coating a plurality of hermetic connectors, each hermetic connector having a plurality of metallic contact elements embedded into an electrical connector insulator wherein said insulator is encased in a metallic cylindrical outer body, the apparatus comprising:

a plurality of jet cells for receiving the hermetic connectors, wherein each jet cell is configured to hold and to discharge an electrolyte into the jet cell for electroplating a portion of the metallic contact elements;

a containment tank having a circulation arrangement to provide circulation of the electrolyte through said plurality of jet cells by means of a pump connected to a plurality of pipes and valves;

an anode positioned within said containment tank and connected to a positive electrode of a power supply for conducting an electric current through the electrolyte;

a plurality of conducting devices mounted on a support plate and connected to a negative electrode of the power supply for providing the electric current to each of the hermetic connectors, wherein each of said plurality of conducting devices is positioned along its vertical center axis in coaxial alignment with each of the hermetic connectors; and a linear actuator for vertically engaging said plurality of conducting devices on the metallic contact elements.

2. The electroplating apparatus of claim 1, wherein the apparatus further comprises a receiving device for receiving the hermetic connectors simultaneously.

3. The electroplating apparatus of claim 1, wherein said linear actuator comprises a reciprocating element for disengaging said plurality of conducting devices.

4. The electroplating apparatus of claim 1, wherein said plurality of conducting devices simultaneously engage with an opposite portion of the metallic contact elements from the portion to be plated.

5. The electroplating apparatus of claim 1, wherein the apparatus comprises a plurality of slider plates that may be applied in various configurations for adaptability to various sizes of the hermetic connectors.

6. The electroplating apparatus of claim 1, wherein said plurality of conducting devices include a conducting graphite fabric.

7. The electroplating apparatus of claim 1, wherein said plurality of conducting devices further comprise a plurality of spring loaded contacts for applying pressure on the metallic contact elements.

8. The electroplating apparatus of claim 1, wherein the apparatus further comprises volumetric control valves for controlling the supply of electrolyte.

9. The electroplating apparatus of claim 1, the apparatus further comprises an uprightly oriented nozzle surrounded by a containment shell which is fitted into an adjustment sleeve for level control of the electrolyte, wherein said adjustment sleeve has a plurality of drain holes with corresponding drain holes provided in said containment shell.

* * * * *